United States Patent [19]

Henschel

[11] Patent Number: 4,637,077

[45] Date of Patent: Jan. 20, 1987

[54] FORM-RETAINING INSERT FOR CAPS

[76] Inventor: Edward W. Henschel, 13966 Meursalt La., Chesterfield, Mo. 63017

[21] Appl. No.: 837,349

[22] Filed: Mar. 7, 1986

Related U.S. Application Data

[63] Continuation-in-part of Ser. No. 718,632, Apr. 1, 1985, abandoned.

[51] Int. Cl.[4] ..... A42C 5/00; D06C 29/00

[52] U.S. Cl. ..... 2/185 B; 2/195; 223/84

[58] Field of Search ..... 2/185 B, 185 C, 185 R, 2/175, 195, 199; 223/84, 24, 66

[56] References Cited

U.S. PATENT DOCUMENTS

| | | | |
|---|---|---|---|
| 1,656,073 | 1/1928 | Nixon | 2/185 B |
| 1,877,452 | 9/1932 | Gagné | 2/185 B |
| 2,740,567 | 4/1956 | Kaufman | 2/185 B |
| 2,915,231 | 12/1959 | Henschel | 223/84 |

FOREIGN PATENT DOCUMENTS

| | | | |
|---|---|---|---|
| 242881 | 11/1925 | United Kingdom | 2/185 B |

*Primary Examiner*—Werner H. Schroeder
*Assistant Examiner*—J. L. Olds

[57] ABSTRACT

A form-maintaining insert for a cap which underlies the crown of a cap in face-to-face relation and provides tension in order to resist wrinkling or creasing of the crown so that the rear wall of the cap may be folded inwardly thereby reducing the space occupied by the cap.

20 Claims, 6 Drawing Figures

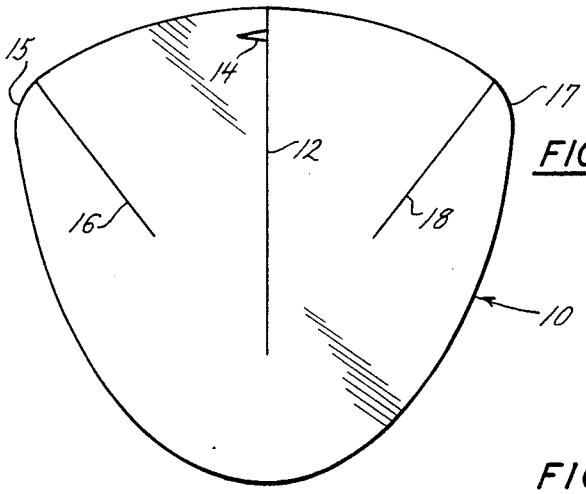
FIG. 1.
FIG. 2.
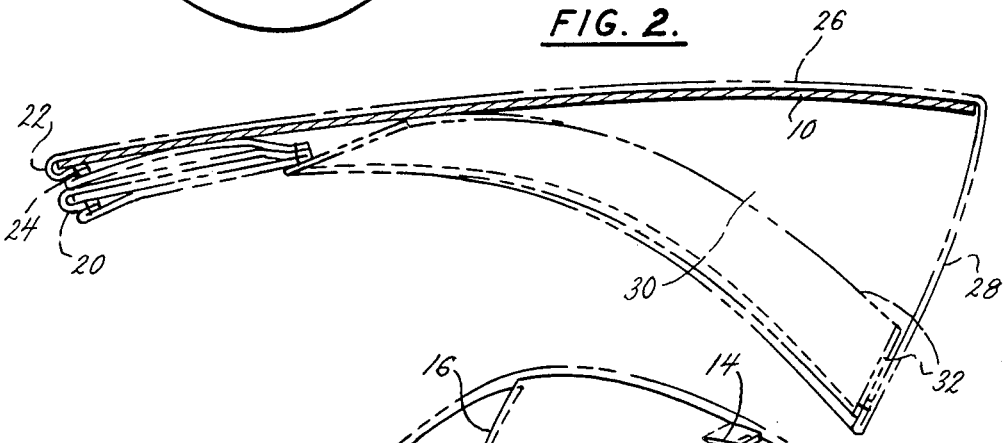
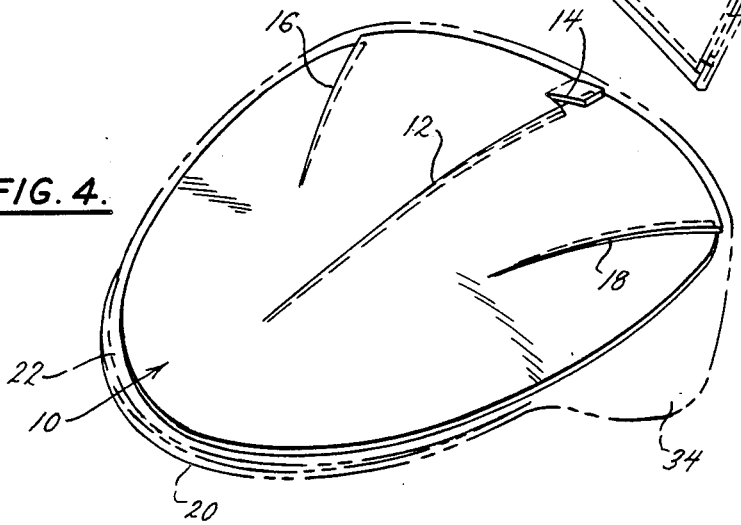
FIG. 4.
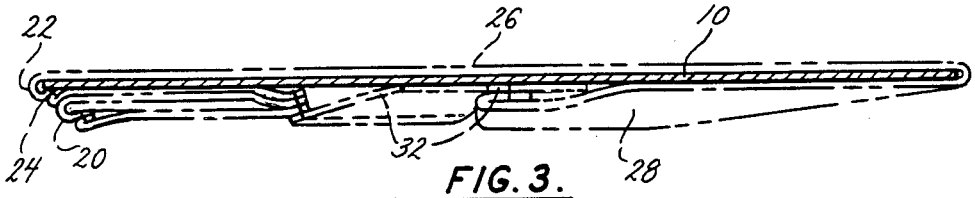
FIG. 3.

FIG. 5.
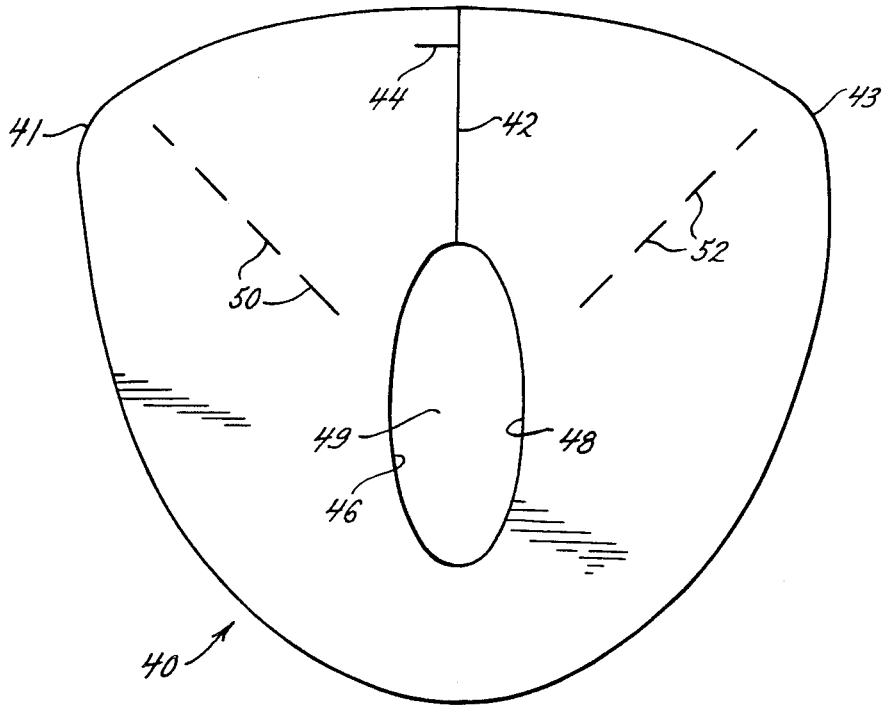
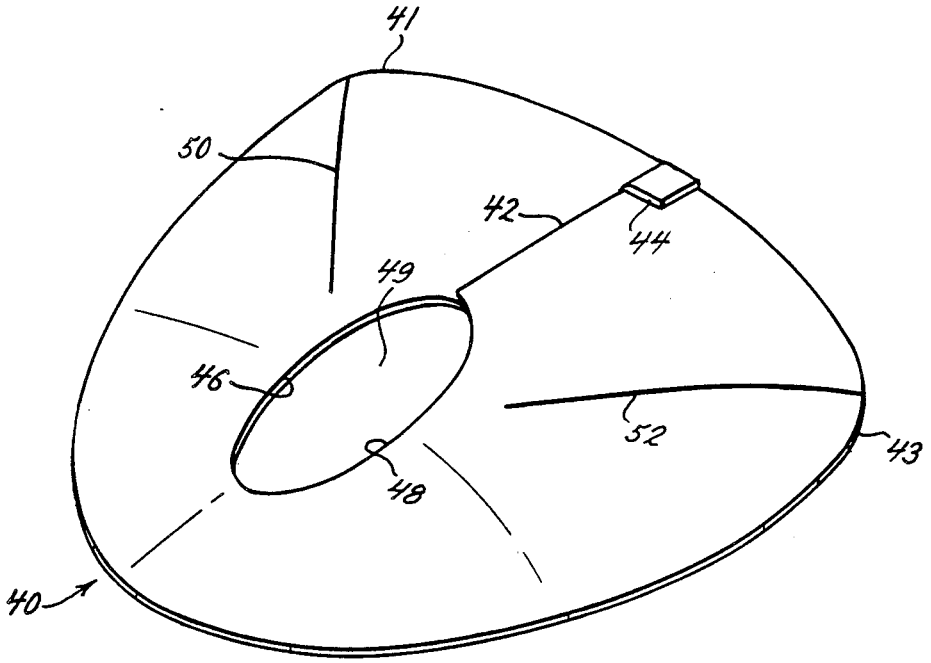
FIG. 6.

FORM-RETAINING INSERT FOR CAPS

This application is a continuation-in-part of my application Ser. No. 06/718,632 for FORM-RETAINING INSERT FOR CAPS which was filed on Apr. 1, 1985 and allowed on Dec. 23, 1985, now abandoned.

Caps, which are to be worn by people, are frequently made so they are soft and readily bendable. When such caps are packed in cartons for shipment, and when those cartons are set, or dropped, on their sides during shipment, those caps can shift within those cartons and develop undesirable creases or wrinkles in the crowns thereof. It would be desirable to provide a form-retaining insert for a cap which could be positioned within that cap in face-to-face relation with the crown of that cap to keep that crown substantially smooth and substantially free from creases and wrinkles during shipment of that cap. Further, it would be desirable for that form-retaining insert to provide a fold line about which the rear wall of the cap could be folded inwardly into confronting relation with the under surface of the crown of that cap, so that cap would occupy only a very small space during shipment. The present invention provides such a form-retaining insert; and, when that insert is disposed within a cap in face-to-face relation with the inner surface of the crown of the cap, that insert will minimize the development of wrinkles or creases in the crown of a cap, and also will provide a fold line for the rear wall of that cap. It is, therefore, an object of the present invention to provide a form-retaining insert for a cap which can minimize the development of wrinkles or creases in the crown of that cap and which can provide a fold line for the rear wall of that cap.

Some caps are so soft and so readily bendable that they are unable, unless they are supported, to provide the distinctive and desired configurations which they will have when worn on person's heads. As a result, unless such a cap is placed on the head of a manikin or on some comparable support, it will not present its most appealing and marketable appearance. It would be desirable to provide an insert for a cap which would enable that cap to present its most appealing and marketable appearance even when that cap was resting on a shelf or table. The present invention provides such a form-retaining insert; because that insert can be bent by a merchandiser to assume a configuration which will cause a cap, in which it is disposed, to have an appearance that will approximate the appearance which that cap will present when it is being worn. It is, therefore, an object of the present invention to provide a form-retaining insert which can be used by a merchandiser to give a cap an appearance that will approximate the appearance which that cap will have when it is being worn.

Other and further objects and advantages of the invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

BRIEF DESCRIPTION OF DRAWING

In the drawing, FIG. 1 is a plan view, on a reduced scale, of one preferred embodiment of form-retaining insert which is provided by the present invention;

FIG. 2 is a vertical sectional view, on a scale which is larger than that of FIG. 1 but which is smaller than full scale, along a longitudinal line through the insert of FIG. 1 as that insert is disposed within a cap before the rear wall of that cap has been folded up against that insert;

FIG. 3 is a vertical sectional view, on the scale of FIG. 2, after the rear wall of the cap has been folded up against the insert;

FIG. 4 is a perspective view, on the scale of FIG. 1, of the insert of FIG. 1 as it appears when it is disposed within a cap and before a merchandiser bends that insert to effectively display that cap;

FIG. 5 is a plan view, on a reduced scale, of a second preferred embodiment of form-retaining insert which is provided by the present invention; and FIG. 6 is a perspective view, on the scale of FIG. 5, of the insert of FIG. 5 as it appears when the rear portions have been lapped and the inclined severance lines have been made into full-depth severance lines.

DETAILED DESCRIPTION OF PREFERRED EMBODIMENT IN FIGS. 1–4

Referring to the drawing in detail, the numeral 10 generally denotes one preferred embodiment of form-retaining insert which is made in accordance with the principles and teachings of the present invention. That insert preferably is made from a relatively-stiff form-retaining material such as the stiff paperboard which is customarily used in making inserts for caps and hats and which is known in the trade as chipboard. That insert could, if desired, be made from plastic, from impregnated paper, from impregnated fabric or from other material; but the stiff paperboard which is customarily used for making inserts for caps and hats has been found to be economical and to have desirable form-retaining properties. Whatever material is used in making the insert 10 must be non-toxic and must be color-fast.

The insert 10 has a curved front edge which is symmetrical about the longitudinal axis of that insert. The insert 10 has a larger radius curved rear edge which is symmetrical about that longitudinal axis. The side edges of the insert 10 are curved; and they extend rearwardly from the curved front edge to small-radius arcs 15 and 17 which merge into the curved rear edge of that insert. The length of the longitudinal axis of the insert 10 is close to the length of the longitudinal axis of the crown of the cap with which that insert is to be used. However, the width of the insert 10, as measured adjacent the small-radius arcs 15 and 17, is greater than the width of the crown of the cap with which that insert is to be used. In one preferred embodiment of insert which is provided by the present invention and which is to be used with a cap that has a crown width of nine and three-quarters ($9\frac{3}{4}$) inches, the straight-line distance between the small-radius arcs 15 and 17 is ten and one-half ($10\frac{1}{2}$) inches. The longitudinal dimensions of the crown of that cap and of that insert are about nine (9) inches.

The numeral 12 denotes an elongated severance line which is provided in the insert 10 along the longitudinal axis of that insert. That severance line can be made as a full-depth cut, as a series of full-depth perforations, as a very deep crease, as a crease on the front surface in register with an aligned crease on the rear surface of that insert, or in any other way customarily used in forming severance lines in stiff paperboard. That severance line starts at the rear edge of the insert 10 and it extends forwardly through the longitudinal center of that insert; but it stops short of the front edge of that insert. The numeral 14 denotes a notch in the right-hand rear portion of the insert 10 (as that insert is viewed from rear to front); and that notch opens to the severance line 12. The numeral 16 denotes a further severance line in the insert 10 which is inclined relative to, and which is considerably shorter than, the severance line 12. That severance line starts at the rear edge of the insert 10 adjacent the small-radius arc 15; and it inclines forwardly and inwardly through that rear portion toward the middle of that insert. The numeral 18 denotes a severance line which is a mirror image of the severance line 16; and that severance line starts at the rear edge of the insert 10 adjacent the small-radius arc 17. The severance lines 16 and 18 preferably are not formed by full-depth cuts and, instead, are formed so cutting or tearing forces must be applied to them to open them from surface to surface of the insert 10 throughout the lengths thereof. The severance lines 12, 16 and 18 are formed so the insert 10 can lie in a planar state until the portions of that insert which confront those severance lines are caused to lap.

When a user wishes to dispose the insert 10 within a cap, that user will make certain that the severance line 12 extends from surface to surface throughout its length, and then will raise one of the rear portions of that insert upwardly above the other rear portion and cause one of the confronting edges of those rear portions to lap the other confronting edge. In those instances where the severance line 12 is formed by a full-depth cut, it will only be necessary to raise the one confronting edge upwardly and lap it over the other confronting edge. In those instances where the severance line 12 is formed by perforations, by creases or in other ways, the user will use cutting or tearing forces to free the confronting edges of the rear portions so they can be lapped. As the confronting edges of the rear portions are lapped, those rear portions will experience a slight upward bowing of the upper surfaces thereof. After the confronting edges adjacent the severance line 12 have been lapped, the forward end of the insert 10 will be moved downwardly within the crown of the cap with which it is used; and such a crown is denoted in FIGS. 2 and 3 by the numeral 26. The forward end 22 of that crown is generally in register with the forward end of the bill 20 of that cap. A fastening, which can be one or more threads, snap fasteners, or other devices customarily used in the cap industry, is denoted by the numeral 24; and it will keep the front 22 of crown 26 in close proximity to the front of the bill 20. The crown 26 merges into a rear wall 28 and also merges into a left-hand side wall 30 and a right-hand side wall 34. A sweat band 32 is secured to the inner edge of the bill 20, and also to the inner faces of the lower edges of rear wall 28 and side walls 30 and 34. That cap, and any other cap with which the insert 10 will be used, will be of standard and usual design and construction; and it is not, per se, a part of the present invention. That cap is shown in dotted lines in the drawing to illustrate the manner in which the insert 10 is used.

Once the forward end of insert 10 has been disposed within the cap, that forward end will be moved forwardly until it is immediately adjacent the connection between the forward end 22 of crown 26 and the forward ends of the side walls 30 and 34 of that cap. Thereupon the lapping of the edges, of the rear portions of insert 10 which confront the severance line 12, will be increased until the small-radius portions 15 and 17 are able to pass downwardly and inwardly between the portions of sweat band 32 that are close to the junctions between side walls 30 and 34 and rear wall 28. The insert 10 will then be moved into close face-to-face relation with the exposed surface of the crown 26; and, at such time, one arcuate side of that insert will be close to the junction between the right-hand side of that crown and the contiguous portion of side wall 30, while the other arcuate side of that insert will be close to the junction between the left-hand side of that crown and the contiguous portion of side wall 34. In the preferred embodiment of the present invention, those arcuate sides of insert 10 will be in intimate engagement with those contiguous portions of those side walls. Also at such time, the rear edge of insert 10 will be disposed closely adjacent the rear portion of crown 26 and the contiguous portion of rear wall 28. In the preferred embodiment of the present invention, that rear edge will be in intimate engagement with that contiguous portion of that rear wall.

The material of which the insert 10 is made will have a "memory," and hence will tend to resist any bending or bowing of any portion of that insert. Returning or restorative forces will have been developed within the insert 10 as the edges, which confront the severance line 12, were lapped; and those returning or restorative forces will urge the rear portions of that insert toward their initial, un-lapped positions, and hence into intimate engagement with the portions of the cap which they confront. Where, as in the preferred embodiment of the present invention, the curved sides of insert 10 engage the portions of side walls 30 and 34 which are contiguous to the side edges of crown 26, the returning or restorative forces within that insert will cause the curved sides of that insert to develop moderate tensile forces in the crown 26 and in the contiguous portions of side walls 30 and 34. Those tensile forces will tend to keep the crown 26 substantially free of wrinkles and creases; even if the carton in which the cap and other caps are packed is set, or dropped, on its side.

The disposition of the rear edge of insert 10 adjacent the junction between the rear of crown 26 and the contiguous portion of rear wall 28 will define a curved fold line about which that contiguous portion of that rear wall can be folded forwardly and toward the exposed surface of insert 10, as shown particularly by FIG. 3. In FIG. 2, the rear wall 28 and the rear portions of side walls 30 and 34 are shown close to their normal positions, wherein they are angularly displaced from the crown 26; but in FIG. 3, that rear wall is shown after it has been moved forwardly and toward the exposed surface of insert 10 until the sweat band 32 abuts that exposed surface. As that rear wall is moved forwardly and toward that exposed surface of insert 10, a fold will be formed in side wall 30 close to the junction between that side wall and rear wall 28; and a further fold will be formed in side wall 34 close to the junction between that side wall and that rear wall. Portions of those side walls will bow outwardly short distances, as those folds are formed, to permit those side walls to be folded compactly. The overall result is that when the insert 10 has been disposed within the cap with one of its surfaces in face-to-face relation with the inner surface of crown 26, and the rear wall 28 of that cap has been moved forwardly about the rear edge of that insert until it is immediately adjacent a confronting surface of that insert, that cap will have a slightly-tensioned, substantially-flat crown, will have a rear wall that has a neat curved fold therein which permits the major portion of that rear wall to be disposed immediately adjacent that confronting surface of that insert, and will have the side walls 30 and 34 thereof folded compactly. At such time, the cap will occupy a minimum amount of space, and hence it can be packed and shipped very economically; and yet the crown 26 of that cap would be kept from being creased or wrinkled even if the carton in which that cap was packed were to be set on one side or even were to be dropped on one side.

The insert provided by the present invention can be used with several caps which have the same style and configuration but which are of different sizes. As a result, only a limited number of sizes of inserts would be needed by most manufacturers of caps.

When a cap with the insert 10 therein is received by a merchandiser, that merchandiser can, if he so desires, remove that insert and discard it. However, that insert can be retained within the cap, and can then be used to provide that cap with a desirable three-dimensional appearance which will enhance the salability and appeal of that cap. Specifically, the merchandiser can cause the confronting edges which are defined by the severance line 16 to lap each other, and also can cause the confronting edges which are defined by the severance line 18 to lap each other. Where those severance lines are formed by perforations or creases, those severance lines will have cutting or tearing forces applied to them to cause them to extend from one surface of insert 10 to the other so the confronting edges defined thereby can be lapped.

Once the confronting edges defined by the severance lines 16 and 18 have been lapped, the notch 14 in one of the confronting edges defined by the severance line 12 will be telescoped over the confronting portion of the adjacent edge defined by that severance line. Thereafter, that notch and that confronting portion will hold the rear portions of those confronting edges immediately adjacent each other, as indicated particularly by FIG. 2. The merchandiser can then bend the rear portions, and the rear areas of the sides, of insert 10 downwardly to cause that insert to assume a convex configuration which will approximate the convex configuration that the crown 26 of the cap should assume when that cap is worn. The paperboard, or other material of which the insert 10 is made, will have to be bent beyond its elastic limit to enable it to take a "set"; but the force required to bend that insert to that extent is well within the capabilities of the average individual. The confronting edges defined by the severance lines 16 and 18 will become progressively lapped during the downward bending of insert 10; and hence the overall width of the rear of that insert will decrease. As a result, the side edges of that insert will move closer to the lines where the normal changes of surface between rear wall 28 and side walls 30 and 34 are experienced.

When the merchandiser has bent the insert 10 to give the cap an appealing and marketable appearance, that insert will continue to provide that appearance for that cap, even though that cap is merely laid on a shelf or table. That appealing and marketable appearance will be in sharp contrast to the droopy appearance of a soft and readily bendable cap which does not have an insert 10 therein when it is laid on a shelf or table. Even if a merchandiser does not wish to bend the insert 10 to give it a convex configuration which approximates the ultimate convex configuration desired for the crown of that cap, he can leave that insert within that cap to keep the crown of that cap from drooping while that cap is lying on a shelf or table.

If desired, the rear and side edges of the insert 10 could be bent so extensively that the insert would have a configuration that would approximate the configuration of the top of a person's head. Where that was done, the insert 10 could be left within the cap during the time the cap was being tried on by prospective purchasers. In such instances, that insert would keep the inner surface of the crown 26 of the cap free from the oils and other materials customarily noted on the hair of prospective purchasers.

It thus should be apparent that the insert which is provided by the present invention can facilitate the folding of a cap when that cap is being packed for shipment, and also can maintain the crown of that cap substantially free from wrinkling or creasing during shipment, even if the carton in which that cap was packed were to be set on one side or were even to be dropped on one side. Further, that insert can be used in a merchandiser's store to provide an appealing and marketable appearance for that cap. In addition, if desired, that insert can be bent to such an extent that it can be retained within a cap as that cap is being tried on by prospective purchasers.

DETAILED DESCRIPTION OF PREFERRED EMBODIMENT IN FIGS. 5 AND 6

Referring to FIGS. 5 and 6 in detail, the numeral 40 generally denotes a second preferred embodiment of form-retaining insert which is made in accordance with the principles and teachings of the present invention. That insert, like the insert 10, preferably is made from chipboard. That insert could, if desired, be made from plastic, from impregnated paper, from impregnated fabric or from other material; but the stiff paperboard which is customarily used for making inserts for caps and hats has been found to be economical and to have desirable form-retaining properties. Whatever material is used in making the insert 40 must be non-toxic and must be color-fast.

The insert 40 has a curved front edge which is symmetrical about the longitudinal axis of that insert. The insert 40 has a larger radius curved rear edge which is symmetrical about that longitudinal axis. The side edges of the insert 40 are curved; and they extend rearwardly from the curved front edge to small-radius arcs 41 and 43 which merge into the curved rear edge of that insert. The length of the longitudinal axis of the insert 40 is close to the length of the longituoinal axis of the crown of the cap with which that insert is to be used. However, the width of the insert 40, as measured adjacent the small-radius arcs 41 and 43, is greater than the width of the crown of the cap with which that insert is to be used. In one preferred embodiment of insert which is provided by the present invention and which is to be used with a cap that has a crown width of nine and one-quarter ($9\frac{1}{4}$) inches, the straight-line distance between the small-radius arcs 41 and 43 is nine and three-quarters ($9\frac{3}{4}$) inches. The longitudinal dimensions of the crown of that cap and of that insert are about nine (9)

inches. Hence the insert 40, like the insert 10, is wider than it is long.

The numeral 42 denotes an elongated severance line which is provided in the insert 40 along the longitudinal axis of that insert. That severance line can be made as a full-depth cut, as a series of full-depth perforations, as a very deep crease, as a crease on the front surface in register with an aligned crease on the rear surface of that insert, or in any other way customarily used in forming severance lines in stiff paperboard. That severance line starts at the rear edge of the insert 40 and its sides merge into edges 46 and 48 which define an open space 49. The sides of the severance line 42 and the edges 46 and 48 coact to define edges that are moveable relative to each other in a direction normal to the insert 40 and that extend forwardly through the longitudinal center of that insert, but that stop short of the front edge of that insert. The numeral 44 denotes a short severance line in the right-hand rear portion of the insert 40 (as that insert is viewed from rear to front); and that severance line is contiguous to the severance line 42. The numeral 50 denotes a further severance line in the insert 40 which is inclined relative to the severance line 42, and which is considerably shorter than the combined lengths of severance line 42 and open space 49. That severance line starts at the rear edge of the insert 40 adjacent the small-radius arc 41; and it inclines forwardly and inwardly through that rear portion toward, but stops well short of, the open space 49. The numeral 52 denotes a severance line which is a mirror image of the severance line 50; and that severance line starts at the rear edge of the insert 40 adjacent the small-radius arc 43. The severance lines 50 and 52 preferably are not formed by full-depth cuts and, instead, preferably are formed so cutting or tearing forces must be applied to them to make them full depth severance lines throughout the lengths thereof. The severance lines 42, 50 and 52 are formed so the insert 40 can lie in a planar state until the portions of that insert which confront those severance lines are caused to lap.

When a user wishes to dispose the insert 40 within a cap, that user will make certain that the severance line 42 is a full depth severance line throughout its length; and then will raise one of the rear portions of that insert upwardly above the other rear portion and cause one of the confronting edges of those rear portions to lap the other confronting edge. In those instances where the severance line 42 is formed by a full-depth cut, it will only be necessary to raise the one confronting edge upwardly and lap it over the other confronting edge. In those instances where the severance line 42 is formed by perforations, by creases or in other ways, the user will use cutting or tearing forces to free the confronting edges of the rear portions so they can be lapped. As the confronting edges of the rear portions are lapped, those rear portions will effectively pivot about the foremost point of the open space 49; and, because the combined length of that open space and of severance line 42 is close to the overall length of the insert 40, those rear portions will experience very little upward bowing. After the confronting edges adjacent the severance line 42 have been lapped, the forward end of the insert 40 will be moved downwardly within the crown of a cap with which it is to be used; and such a crown will be similar to the crown 26 in FIGS. 2 and 3. That cap, and any other cap with which the insert 40 will be used, will be of standard and usual design and construction; and it will not, per se, be a part of the present invention.

Once the forward end of insert 40 has been disposed within the cap, that forward end will be moved forwardly until it is immediately adjacent the connection between the forward end 22 of crown 26 and the forward ends of the side walls 30 and 34 of that cap. Thereupon the lapping of the edges, of the rear portions of insert 40 which confront the severance line 42, will be increased until the small-radius portions 41 and 43 are able to pass downwardly and inwardly between the portions of sweat band 32 that are close to the junctions between side walls 30 and 34 and rear wall 28. The insert 40 will then be moved into close face-to-face relation with the exposed surface of the crown 26; and, at such time, one arcuate side of that insert will be close to the junction between the right-hand side of that crown and the contiguous portion of side wall 30, while the other arcuate side of that insert will be close to the junction between the left-hand side of that crown and the contiguous portion of side wall 34. In the embodiment of FIGS. 5 and 6, as well as in the embodiment of FIGS. 1–4, the arcuate sides of the insert will be in intimate engagement with the contiguous portions of the side walls. Also at such time, the rear edge of the insert will be disposed closely adjacent the rear portion of crown 26 and the contiguous portion of rear wall 28. Also, the open space 49 will surround the geometric center of the crown; but that open space will largely lie between that center and the forward edge of that crown.

The open space 49 is shown as being generally elliptical in configuration; and such a configuration is desirable, because it permits solid and uninterrupted areas of appreciable widths to be provided between the edges 46 and 48 and the inner ends of the severance lines 50 and 52. However, if desired, various arcuate and polygonal configurations could be provided for that open space. The basic requirements for that open space are that the edges thereof be contiguous to, or be capable of being made contiguous to, the sides of severance line 42, that the edges thereof be spaced inwardly from the inner ends of severance lines 50 and 52, and that the forwardmost portion of that open space be close to the front edge of that insert.

The material of which the insert 40 is made will have a "memory," and hence will tend to resist any bending or bowing of any portion of that insert. Returning or restorative forces will have been developed within the insert 40 as the edges, which confront the severance line 42, were lapped; and those returning or resto:ative forces will urge the rear portions of that insert toward their initial, un-lapped positions, and hence into intimate engagement with the portions of the cap which they confront. When the curved sides of insert 40 engage the portions of side walls 30 and 34 which are contiguous to the side edges of crown 26 of a cap, the returning or restorative forces within that insert will cause the curved sides of that insert to develop moderate tensile forces in the crown 26 and in the contiguous portions of side walls 30 and 34. Those tensile forces will tend to keep the crown 26 substantially free of wrinkles and creases; even if the carton in which the cap and other caps are packed is set, or dropped, on its side.

The disposition of the rear edge of insert 40 adjacent the junction between the rear of crown 26 and the contiguous portion of rear wall 28 of a cap will define a curved fold line about which that contiguous portion of that rear wall can be folded forwardly and toward the exposed surface of insert 40, in the same manner in which the rear wall of the cap in FIG. 3 is folded. As that rear wall is moved forwardly and toward that exposed surface of insert 40, folds will be formed in the side walls of the cap close to the junctions between those side walls and the rear wall 28. Portions of those side walls will bow outwardly short distances, as those folds are formed, to permit those side walls to be folded compactly. The overall result is that when the insert 40 has been disposed within a cap with one of its surfaces in face-to-face relation with the inner surface of the crown, and the rear wall of that cap has been moved forwardly about the rear edge of that insert until it is immediately adjacent a confronting surface of that insert, that cap will have a slightly-tensioned, substantially-flat crown, will have a rear wall that has a neat curved fold therein which permits the major portion of that rear wall to be disposed immediately adjacent that confronting surface of that insert, and will have the side walls thereof folded compactly. At such time, the cap will occupy a minimum amount of space, and hence it can be packed and shipped very economically; and yet the crown of that cap would be kept from being creased or wrinkled even if the carton in which that cap was packed were to be set on one side or even were to be dropped on one side.

The insert 40 can be used with several caps which have the same style and configuration but which are of different sizes. As a result, only a limited number of sizes of inserts would be needed by most manufacturers of caps.

When a cap with the insert 40 therein is received by a merchandiser, that merchandiser can, if he so desires, remove that insert and discard it. However, that insert can be retained within the cap, and can then be used to provide that cap with a desirable three-dimensional appearance which will enhance the salability and appeal of that cap. Specifically, the merchandiser can cause the confronting edges which are defined by the inclined severance line 41 to lap each other, and also can cause the confronting edges which are defined by the inclined severance line 43 to lap each other. Where those severance lines are formed by perforations or creases, those severance lines will have cutting or tearing forces applied to them to cause them to become full-depth severance lines, so the confronting edges defined thereby can be lapped.

Once the confronting edges defined by the inclined severance lines 41 and 43 have been lapped, the severance line 44 will be telescoped over the confronting portion of the adjacent edge defined by severance line 42. Thereafter, the severance line 44 and that confronting portion will hold the rear portions of those confronting edges immediately adjacent each other. The merchandiser can then bend the rear portions, and the rear areas of the sides, of insert 40 downwardly to cause that insert to assume a convex configuration which will approximate the convex configuration that the crown of the cap should assume when that cap is worn. The paperboard, or other material of which the insert 40 is made, will have to be bent beyond its elastic limit to enable it to take a "set"; but the force required to bend that insert to that extent is well within the capabilities of the average individual. The confronting edges defined by the inclined severance lines 41 and 43 will become progressively lapped during the downward bending of insert 40; and hence the overall width of the rear of that insert will decrease. As a result, the side edges of that insert will move closer to the lines where the normal changes of surface between rear wall 28 and side walls 30 and 34 of that cap are experienced.

When the merchandiser has bent the insert 40 to give the cap an appealing and marketable appearance, that insert will continue to provide that appearance for that cap, even though that cap is merely laid on a shelf or table. That appealing and marketable appearance will be in sharp contrast to the droopy appearance of a soft and readily bendable cap which does not have an insert 40 therein when it is laid on a shelf or table. Even if a merchandiser does not wish to bend the insert 40 to give it a convex configuration which approximates the ultimate convex configuration desired for the crown of that cap, he can leave that insert within that cap to keep the crown of that cap from drooping while that cap is lying on a shelf or table.

If desired, the rear and side edges of the insert 40 could be bent so extensively that the insert would have a configuration that would approximate the configuration of the top of a person's head. Where that was done, the insert 40 could be left within the cap during the time the cap was being tried on by prospective purchasers. In such instances, that insert would keep large areas of the inner surface of the crown of the cap free from the oils and other materials sometimes noted on the hair of prospective purchasers of caps.

It thus should be apparent that the inserts which are provided by the present invention can facilitate the folding of a cap when that cap is being packed for shipment, and also can maintain the crown of that cap substantially free from wrinkling or creasing during shipment, even if the carton in which that cap was packed were to be set on one side or were even to be dropped on one side. Further, those inserts can be used in a merchandiser's store to provide an appealing and marketable appearance for that cap. In addition, if desired, those inserts can be bent to such an extent that they can be retained within a cap as that cap is being tried on by prospective purchasers.

Whereas the drawing and accompanying description have shown and described two preferred embodiments of tne present invention, it should be apparent to those skilled in the art that various changes may be made in the form of the invention without affecting the scope thereof.

What I claim is:

1. A form-maintaining insert for a cap which comprises a generally flat sheet of form-retaining material that has a front portion which is generally similar to the front portion of the crown of said cap and which is insertable within the front portion of said cap to underlie and to confront said front portion of said crown in face-to-face relation and that has a rear portion which is generally similar to the rear portion of said crown of said cap and which is insertable within the rear portion of said cap to underlie and to confront said rear portion of said crown in face-to-face relation, said front portion of said sheet having a curved periphery, said rear portion of said sheet having a periphery which is, at least in part, curved, said sheet having a severance line therein which extends forwardly from the rear edge of said rear portion into said front portion to define left and right areas for said rear portion which have confronting edges, said left and right areas being bowable to enable the confronting edge on one of said areas to lap over the confronting edge of the other of said areas with a consequent reduction in the effective width of said rear portion of said insert, said insert resisting the bowing of said left and right areas of said rear portion thereof and developing restorative forces which cause said left and right areas of said rear portion to apply outwardly-directed forces to said cap, adjacent the sides of said crown, that will develop tensile forces in said crown which will resist wrinkling or creasing of said crown, said periphery of said rear portion of said sheet providing a fold-line about which the rear wall of said cap can be folded inwardly and adjacent a confronting surface of said sheet to reduce the space occupied by said cap to a desired value.

2. A form-maintaining insert as claimed in claim 1 wherein the maximum width of said rear portion of said insert is greater than the maximum width of said crown of said cap whenever said confronting edges defined by said severance line are in confronting, abutting engagement with each other.

3. A form-maintaining insert as claimed in claim 1 wherein the side edges of said rear portion of said insert engage the upper portions of the side walls of said cap whenever said insert is positioned within said cap in face-to-face relation with the inner surface of said crown of said cap.

4. A form-maintaining insert as claimed in claim 1 wherein the maximum width of said rear portion of said insert is greater than the maximum width of said crown of said cap whenever said confronting edges defined by said severance line are in confronting, abutting engagement with each other, and wherein the side edges of said rear portion of said insert engage the upper portions of the side walls of said cap whenever said insert is positioned within said cap in face-to-face relation with the inner surface of said crown of said cap.

5. A form-maintaining insert as claimed in claim 1 wherein the rear edge of said insert engages the upper portion of said rear wall of said cap whenever said insert is positioned within said cap in face-to-face relation with the inner surface of said crown of said cap.

6. A form-maintaining insert as claimed in claim 1 wherein the maximum width of said rear portion of said insert is greater than the maximum width of said crown of said cap whenever said confronting edges defined by said severance line are in confronting, abutting engagement with each other, and wherein the side edges of said rear portion of said insert engage the upper portions of the side walls of said cap and the rear edge of said insert engages the upper portion of said rear wall of said cap whenever said insert is positioned within said cap in face-to-face relation with the inner surface of said crown of said cap.

7. A form-maintaining insert as claimed in claim 1 wherein additional severance lines extend forwardly from said rear edge of said rear portion of said insert, and wherein said additional severance lines define edges which can be lapped to permit said rear portion of said insert to be bent.

8. A form-maintaining insert as claimed in claim 1 wherein additional severance lines extend forwardly from said rear edge of said rear portion of said insert, and wherein said additional severance lines define edges which can be lapped to permit said rear portion of said insert to be bent, said additional severance lines normally holding the edges defined thereby against lapping but responding to cutting forces to free said edges for lapping movement.

9. A form-maintaining insert as claimed in claim 1 wherein additional severance lines extend forwardly from said rear edge of said rear portion of said insert, wherein said additional severance lines define edges which can be lapped to permit said rear portion of said insert to be bent, and wherein the first said and said additional severance lines can coact to permit said insert to be bent to have a generally spherical configuration that is similar to the generally spherical configuration which said crown will have when said cap is being worn.

10. A form-maintaining insert as claimed in claim 1 wherein additional severance lines extend forwardly from said rear edge of said rear portion of said insert, wherein said additional severance lines define edges which can be lapped to permit said rear portion of said insert to be bent, wherein the first said and said additional severance lines can coact to permit said insert to be bent to have a generally spherical configuration that is similar to the generally spherical configuration which said crown will have when said cap is being worn, and wherein said insert can continue to maintain wrinkle-resisting and crease-resisting tensile forces within said crown after said insert has been bent to have said generally spherical configuration.

11. A form-maintaining insert as claimed in claim 1 wherein said sheet is wider than it is long whenever it is in a unstressed state.

12. A form-maintaining insert for a cap which comprises a generally flat sheet of form-retaining material that has a front portion which is generally similar to the front portion of the crown of said cap and which is insertable within the front portion of said cap to underlie and to confront said front portion of said crown in face-to-face relation and that has a rear portion which is generally similar to the rear portion of said crown of said cap and which is insertable within the rear portion of said cap to underlie and to confront said rear portion of said crown in face-to-face relation, said front portion of said insert having a curved periphery, said rear portion of said insert having a periphery which is, at least in part, curved, said insert having a severance line therein which extends forwardly from the rear edge of said rear portion a substantial distance toward said front portion to define left and right areas for said rear portion, said severance line defining an open space which is spaced rearwardly of the forward-most point on said curved periphery of said front portion and which is spaced a substantial distance forwardly of the rearward-most point on said periphery of said rear portion to dispose said open space in registry with at least a part of the central portion of said crown of said cap, said left and right areas for said rear portion having edges that are intermediate said open space and said periphery of said rear portion and that confront each other, said left and right areas being movable relative to each other to enable the confronting edge on one of said areas to lap over the confronting edge of the other of said areas with a consequent reduction in the effective width of said rear portion of said insert, said insert resisting the relative movement of said left and right areas of said rear portion thereof and developing restorative forces which cause said left and right areas of said rear portion thereof to apply outwardly-directed forces to said cap, adjacent the sides of said crown, that will develop tensile forces in said crown which will resist wrinkling or creasing of said crown, said periphery of said rear portion of said insert providing a fold-line about which the rear wall of said cap can be folded inwardly and adjacent a confronting surface of said insert to reduce the space occupied by said cap to a desired value.

13. A form-maintaining insert as claimed in claim 12 wherein the maxiumum width of said rear portion of said insert is greater than the maximum width of said crown of said cap whenever said intermediate, confronting edges defined by said severance line are in confronting, abutting engagement with each other.

14. A form-maintaining insert as claimed in claim 12 wherein the maxiumum width of said rear portion of said insert is greater than the maximum width of said crown of said cap whenever said intermediate, confronting edges defined by said severance line are in confronting, abutting engagement with each other, and wherein the side edges of said rear portion of said insert engage the upper portions of the side walls of said cap whenever said insert is positioned within said cap in face-to-face relation with the inner surface of said crown of said cap.

15. A form-maintaining insert as claimed in claim 12 wherein the maxiumum width of said rear portion of said insert is greater than the maximum width of said crown of said cap whenever said intermediate, confronting edges defined by said severance line are in confronting, abutting engagement with each other, and wherein the side edges of said rear portion of said insert engage the upper portions of the side walls of said cap and the rear edge of said insert engages the upper portion of said rear wall of said cap whenever said insert is positioned within said cap in face-to-face relation with the inner surface of said crown of said cap.

16. A form-maintaining insert as claimed in claim 12 wherein additional severance lines extend forwardly from said rear edge of said rear portion of said insert but do not extend to said open space, and wherein said additional severance lines define edges which can be lapped adjacent said rear edge of said rear portion to permit said rear portion of said insert to be bent, said additional severance lines normally holding the edges defined thereby against lapping but responding to cutting forces to free said edges for lapping movement.

17. A form-maintaining insert as claimed in claim 12 wherein said insert is dimensioned so it can be generally flat whenever it is disposed within said cap in face-to-face engagement with said inner surface of said crown of said cap.

18. A form-maintaining insert as claimed in claim 12 wherein the front of said open space is closer to the front edge of said front portion of said insert than the rear of said open space is to the rear edge of said rear portion of said insert.

19. A form-maintaining insert as claimed in claim 12 wherein said severance line and said open space define edges that are moveable relative to each other in a direction normal to said insert and that extend forwardly into positions intermediate the front edge of said crown of said cap and the middle of said crown of said cap.

20. A form-maintaining insert as claimed in claim 12 wherein said insert is wider than it is long whenever it is in an unstressed state.

* * * * *